US010018380B2

(12) United States Patent
Morie et al.

(10) Patent No.: US 10,018,380 B2
(45) Date of Patent: Jul. 10, 2018

(54) CRYOGENIC REFRIGERATOR

(71) Applicant: SUMITOMO HEAVY INDUSTRIES, LTD., Tokyo (JP)

(72) Inventors: Takaaki Morie, Tokyo (JP); Mingyao Xu, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 370 days.

(21) Appl. No.: 14/147,717

(22) Filed: Jan. 6, 2014

(65) Prior Publication Data

US 2014/0208774 A1 Jul. 31, 2014

(30) Foreign Application Priority Data

Jan. 30, 2013 (JP) ..... 2013-016073

(51) Int. Cl.
*F25B 9/14* (2006.01)
*F25B 9/10* (2006.01)

(52) U.S. Cl.
CPC . *F25B 9/14* (2013.01); *F25B 9/10* (2013.01)

(58) Field of Classification Search
CPC ..... F25B 9/14; F25B 2309/006; F25B 2309/14181
USPC ..... 62/6
See application file for complete search history.

(56) References Cited

U.S. PATENT DOCUMENTS 5,361,588 A * 11/1994 Asami ..... F25B 9/14 60/520
7,654,096 B2 * 2/2010 Xu et al. ..... 62/6
8,117,855 B2 2/2012 Rafalovich
2011/0061404 A1 * 3/2011 Ishizuka ..... F25B 9/14 62/6

FOREIGN PATENT DOCUMENTS

CN 102844635 12/2012
JP 2001-280728 10/2001
JP 2007-205581 8/2007

* cited by examiner

*Primary Examiner* — Elizabeth Martin
*Assistant Examiner* — Zachary R Anderegg
(74) *Attorney, Agent, or Firm* — IPUSA, PLLC

(57) ABSTRACT

A cryogenic refrigerator includes a compressor that compresses a working gas; an expansion chamber where the working gas compressed by the compressor expands and generates cooling; a valve mechanism including a stator valve and a rotor valve, which rotates with respect to the stator valve; and a forcing mechanism that applies a force to one of the rotor valve or the stator valve toward the other one of the rotor valve or the stator valve. The valve mechanism is configured to switch a flow of the working gas between the compressor and the expansion chamber as the rotor valve rotates. The forcing mechanism is arranged such that the center of the force applied by the forcing mechanism deviates from the center of the valve mechanism.

8 Claims, 6 Drawing Sheets

CRYOGENIC REFRIGERATOR

CROSS-REFERENCE TO RELATED APPLICATIONS

The present application is based on and claims the benefit of priority to Japanese Patent Application No. 2013-016073 filed on Jan. 30, 2013, the entire contents of which are incorporated herein by reference.

BACKGROUND OF THE INVENTION

1. Field of the Invention

The present invention relates to a cryogenic refrigerator that includes a rotary valve.

2. Description of the Related Art

Gifford-McMahon (GM) refrigerators are known as cryogenic refrigerators that can produce cryogenic temperatures. A GM refrigerator produces a refrigeration effect using the Gifford-McMahon refrigeration cycle, which involves reciprocating a displacer within a cylinder using a drive mechanism to create a volume change in a space within the cylinder.

In the GM refrigerator, high-pressure working gas (e.g., helium gas) is supplied to a cylinder, and the working gas is adiabatically-expanded and cooled to a cryogenic temperature. The working gas that is adiabatically-expanded and cooled to a cryogenic temperature is then warmed by absorbing heat from its surrounding and exchanging heat with a regenerator material. After reaching room temperature, the working gas is discharged from the cylinder. In this way, a cryogenic temperature may be maintained within the cylinder. The working gas discharged from the cylinder is transferred to a compressor and is compressed by the compressor. In this way, the working gas is turned into high-pressure working gas. The high-pressure working gas is then reintroduced into the cylinder of the GM refrigerator.

In order to supply the high-pressure working gas into the cylinder and discharge the working gas that is reduced to a low pressure outside the cylinder, the GM refrigerator uses a valve mechanism that is configured to switch between supplying and discharging the working gas in synch with a reciprocating motion of a displacer that is arranged within the cylinder. For example, the GM refrigerator may use a rotary valve as the valve mechanism.

A rotary valve includes a stator valve and a rotor valve, which is rotated with respect to the stator valve. By rotating the rotor valve, the rotary valve may switch paths connected to the cylinder between a supply side path and a discharge side path of the compressor. Also, in the rotary valve of a GM refrigerator, the rotor valve needs to be pressed toward the stator valve or vice versa in order to prevent the working gas from leaking. In one known GM refrigerator, the pressure of the working gas supplied to the cylinder is used to press the stator valve toward the rotor valve. More specifically, when high-pressure working gas is supplied from a side opposite a sliding face of the stator valve, the pressure of the working gas acts on a face of the stator valve on the opposite side of the sliding face of the stator valve, and this pressure is used to press the stator valve toward the rotor valve.

In another known GM refrigerator, a spring is used as mechanism for pressing the stator valve toward the rotor valve. In such a GM refrigerator, the spring is arranged on a face of the stator valve on the opposite side of the rotor valve, and the spring force of the spring is used to press the stator valve toward the rotor valve.

SUMMARY OF THE INVENTION

According to one embodiment of the present invention, a cryogenic refrigerator includes a compressor that compresses a working gas; an expansion chamber where the working gas compressed by the compressor expands and generates cooling; a valve mechanism including a stator valve and a rotor valve, which rotates with respect to the stator valve; and a forcing mechanism that applies a force to one of the rotor valve or the stator valve toward the other one of the rotor valve or the stator valve. The valve mechanism is configured to switch a flow of the working gas between the compressor and the expansion chamber as the rotor valve rotates. The forcing mechanism is arranged such that the center of the force applied by the forcing mechanism deviates from the center of the valve mechanism.

DETAILED DESCRIPTION OF THE PREFERRED EMBODIMENTS

Figure 1:
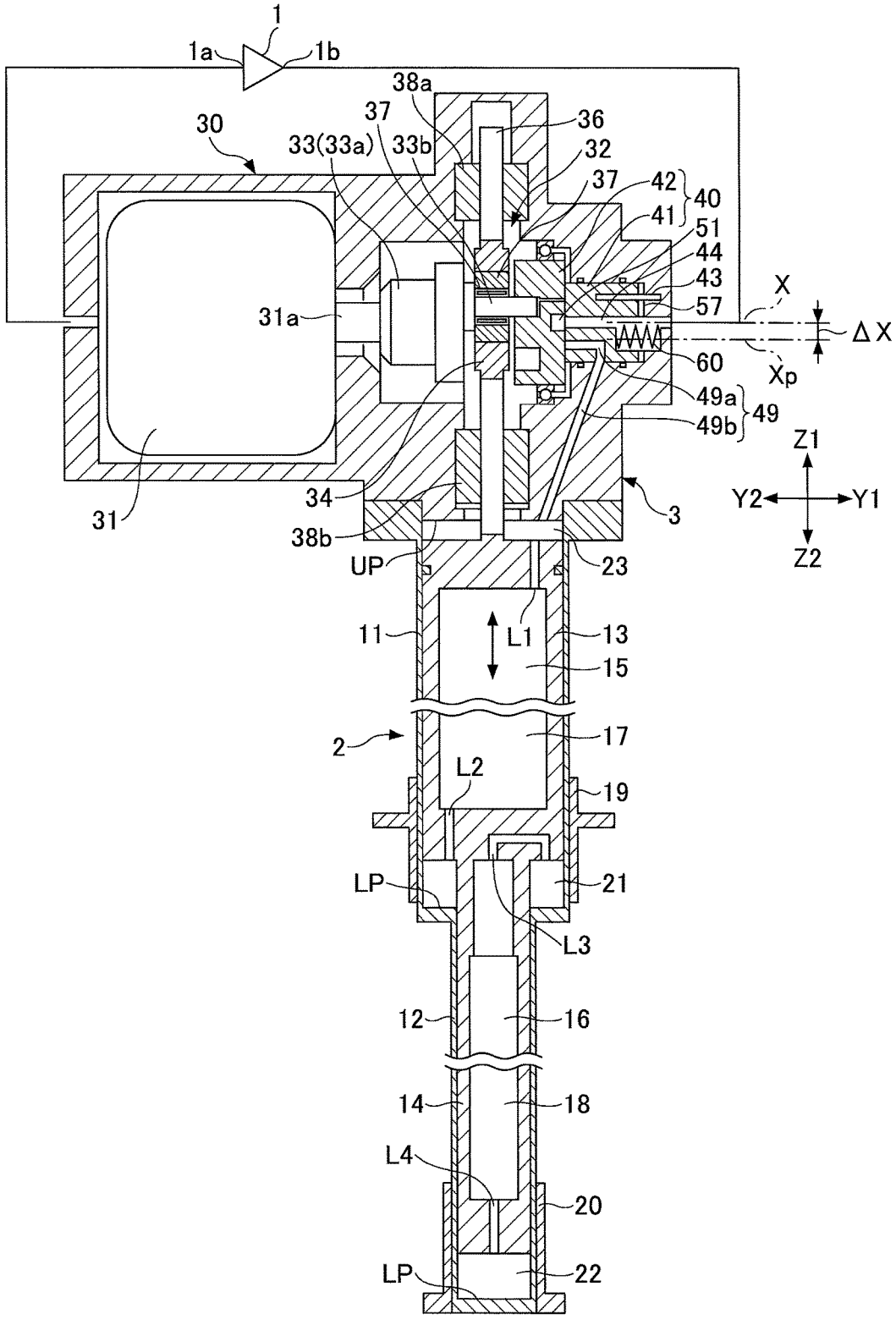
FIG. 1 is a cross-sectional view of a GM refrigerator according to an embodiment of the present invention.

As described above, the GM refrigerator may use a rotary valve that rotates a rotor valve with respect to a stator valve to switch flow paths for the working gas between a supply side path and a discharge side path. To enable such switching, the sliding faces of the stator valve and the rotor valve include elements for forming an end portion of the supply side path and an end portion of the discharge side path, and groove portions for opening the end portions of the flow paths and interconnecting the above end portions at predetermined timings.

The pressure of the high-pressure working gas is applied to the above end portions and groove portions that are arranged on the slide faces of the stator valve and the rotor valve. The slide surfaces are arranged into substantially circular shapes. The above end portions and groove portions are not necessarily located at the center of the sliding faces but may be arranged at positions deviating from the center.

Thus, when the rotor valve rotates with respect to the stator valve, there may be instances where a large amount of pressure is applied to a position deviating from the center of the sliding surfaces depending on the rotating position of the rotor valve. Specifically, at the time a supply operation for supplying high-pressure working gas from the compressor to the cylinder has just been completed, both the pressure of the working gas from the compressor and the pressure of the working gas supplied to the cylinder may be applied to the sliding surfaces.

In some cases, a region of the sliding faces that receives the impact of both pressures (referred to as "bilateral action region" hereinafter) may not be located at the center of the sliding faces (i.e., the bilateral action region may be deviated from the center). Thus, in a configuration where the working gas and a spring are arranged to press the stator valve symmetrically with respect to the center of the stator valve, sealing capability of the sliding faces may be degraded at the bilateral action region and the working gas may be prone to leakage.

To prevent such leakage, the pressure of the working gas and the pressing force of the spring being applied may be increased across the entire regions of the sliding faces. In such a case, sealing capability of the sliding faces may be improved as a result of the increased pressing force and the working gas may be prevented from leaking.

However, when the pressure of the working gas and the pressing force of the spring is increased, excessive friction may be generated between the sliding faces. When the rotary valve is operated while excessive friction is generated between the sliding faces, the slide faces of the stator valve and the rotor valve may wear more easily. When the rotary valve is continually operated in such a state, the life of the rotary valve may be reduced and the rotary valve may have to be replaced more frequently.

Also, a slide resistance of the rotor valve may be increased when the pressing force is increased, and as a result, an excessive load may be applied to the motor driving the rotary valve.

In view of the above, there is a demand for a cryogenic refrigerator that is capable of preventing leakage of the working gas between the stator valve and the rotor valve while reducing friction between the slide faces of the stator valve and the rotor valve.

According to one embodiment of the present invention, a cryogenic refrigerator includes a compressor that compresses a working gas; an expansion chamber where the working gas compressed by the compressor expands and generates cooling; a valve mechanism including a stator valve and a rotor valve, which rotates with respect to the stator valve; and a forcing mechanism that applies a force to one of the rotor valve or the stator valve toward the other one of the rotor valve or the stator valve. The valve mechanism is configured to switch a flow of the working gas between the compressor and the expansion chamber as the rotor valve rotates. The forcing mechanism is arranged such that the center of the force applied by the forcing mechanism deviates from the center of the valve mechanism.

According to an aspect of the present invention, leakage of the working gas between the stator valve and the rotor valve may be prevented without increasing friction between the slide faces of the stator valve and the rotor valve, and operation efficiency of the cryogenic refrigerator may be maintained.

In the following, exemplary embodiments of the present invention are described with reference to the accompanying drawings.

Figure 2:
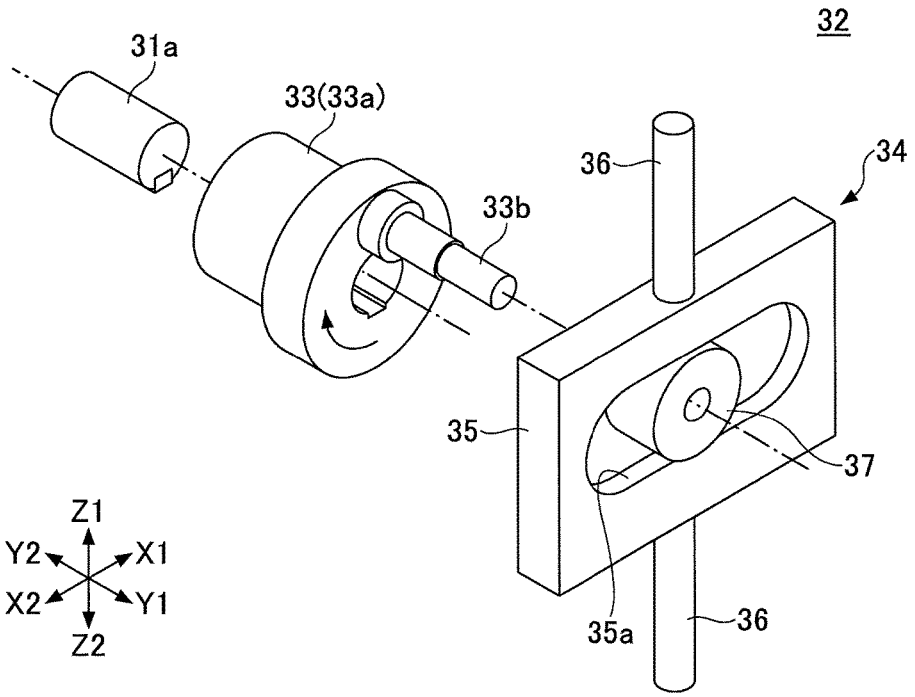
FIG. 2 is an exploded perspective view of a scotch yoke mechanism arranged in a GM refrigerator according to an embodiment of the present invention.
Figure 3:
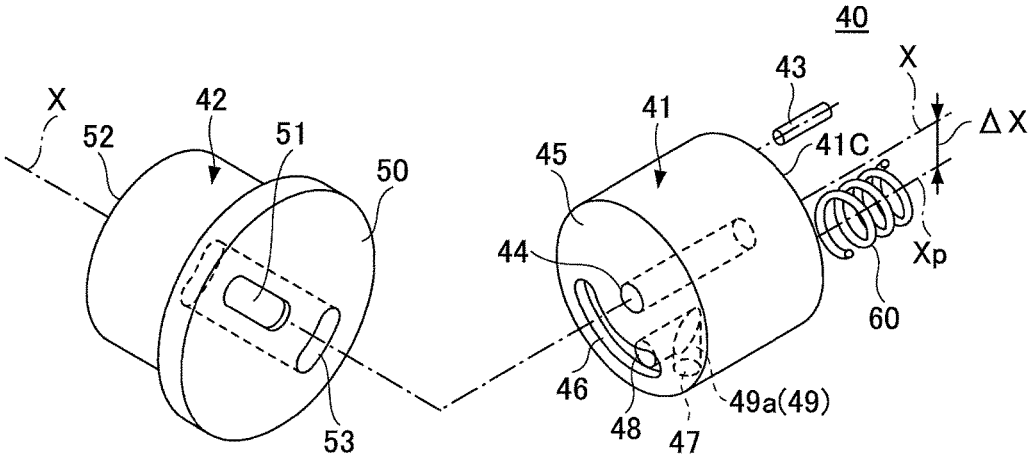
FIG. 3 is an exploded perspective view of a rotary valve arranged in a GM refrigerator according to an embodiment of the present invention.

FIGS. 1-3 illustrate a cryogenic refrigerator according to a first embodiment of the present invention. Note that the cryogenic refrigerator of the present embodiment corresponds to a GM refrigerator. FIG. 1 is a cross-sectional view of the GM refrigerator of the present embodiment; FIG. 2 is an exploded perspective view of a scotch yoke mechanism 32; and FIG. 3 is an exploded perspective view of a rotary valve 40. The GM refrigerator of the present embodiment includes a compressor 1, a cylinder 2, and a housing 3.

The compressor 1 draws in working gas via a low-pressure side 1*a*, compresses the working gas to increase its pressure, and discharges the compressed working gas (high-pressure working gas) via a high-pressure side 1*b*. In one example, helium gas may be used as the working gas.

The GM refrigerator of the present embodiment corresponds to a two-stage type GM refrigerator in which the cylinder 2 includes a first-stage cylinder 11 and a second-stage cylinder 12. The first-stage cylinder 11 has a first-stage displacer 13 installed therein, the first-stage displacer 13 reciprocates in the directions of arrows Z1 and Z2 shown in the drawings (referred to as "Z1 direction" and "Z2 direction" hereinafter). The second-stage cylinder 12 has a second-stage displacer 14 installed therein, the second-stage displacer 14 reciprocates in the Z1 and Z2 directions.

The first-stage cylinder 11 has an upper chamber 23 formed at an upper part of the first-stage displacer 13. Also, the first-stage cylinder 11 has a first-stage expansion chamber 21 formed at a lower part of the first-stage displacer 13. Further, the second-stage cylinder 12 has a second-stage expansion chamber 22 formed at a lower part of the second-stage displacer 14.

An internal chamber 15 corresponding to a flow path for the working gas is formed within the first-stage displacer 13. Also, an internal chamber 16 corresponding to a flow path for the working gas is formed within the second-stage displacer 14. The internal chambers 15 and 16 respectively have regenerator materials 17 and 18 accommodated therein.

The upper chamber 23 and the first-stage expansion chamber 21 are interconnected via gas flow paths L1 and L2 and the internal chamber 15 that are formed within the first-stage displacer 13. Also, the first-stage expansion chamber 21 and the second-stage expansion chamber 22 are interconnected via gas flow paths L3 and L4 and the internal chamber 16 that are formed within the second-stage displacer 14.

A first-stage cooling stage 19 is mounted on the outer peripheral face of the first-stage cylinder 11 at a position facing the first-stage expansion chamber 21. Also, a second-stage cooling stage 20 is arranged on the outer peripheral face of the second-stage cylinder 12 at a position facing the second-stage expansion chamber 22.

The housing 3 includes a drive unit 30 and a rotary valve 40, for example. The drive unit 30 includes a motor 31 and a scotch yoke mechanism 32.

As illustrated in FIG. 2, the scotch yoke mechanism 32 includes a crank member 33 and a scotch yoke 34. The scotch yoke mechanism 32 converts a rotational drive force generated by the motor 31 into a reciprocating drive force and drives the first-stage displacer 13 and the second-stage displacer 14 to reciprocate.

The crank member 33 is fixed to a rotation shaft 31*a* of the motor 31 and is rotated by the motor 31. The crank member 33 includes a crank pin 33*b* that is eccentrically positioned with respect to the mount position of the rotation shaft 31*a* of the motor 31. Thus, when the crank member 33 is mounted to the rotation shaft 31*a*, the rotation shaft 31*a* and the crank pin 33*b* are eccentrically positioned with respect to each other.

The scotch yoke 34 includes a yoke plate 35, a drive shaft 36, and a bearing 37. The scotch yoke 34 is arranged to be capable of reciprocating in the Z1 and Z2 directions within the housing 3. The drive shaft 36 is arranged to extend in upward and downward directions (Z1 and Z2 directions) from an upper side center portion and a lower side center portion of the yoke plate 35.

A laterally long window 35*a* that extends in the directions of arrows X1 and X2 shown in FIG. 2 (referred to as "X1 direction" and "X2 direction" hereinafter) is formed at the yoke plate 35, and the bearing 37 is arranged within the laterally long window 35*a*. The bearing 37 is configured to be capable of rolling and moving in the X1 and X2 directions within the laterally long window 35*a*. Further, the bearing 37 is connected to the crank pin 33*b*.

When the rotation axis 31*a* is rotated while the crank pin 33*b* is connected to the bearing 37, the crank pin 33*b* rotates eccentrically around the rotation axis 31*a*, and in this way, the scotch yoke 34 reciprocates in the Z1 and Z2 directions in FIG. 2. Meanwhile, the bearing 37 reciprocates within the laterally long window 35*a* in the X1 and X2 directions in FIG. 2.

The drive shaft 36, which is arranged at the lower side of the scotch yoke 34, is connected to the first-stage displacer 13. The first-stage displacer 13 is connected to the second-stage displacer 14 by a connection mechanism (not shown). In this way, the scotch yoke 34 drives the first-stage displacer 13 and the second-stage displacer 14 to reciprocate in the Z1 and Z2 directions.

In the following, the rotary valve 40 corresponding to an exemplary embodiment of a valve mechanism is described.

As illustrated in FIG. 1, the rotary valve 40 is arranged between the compressor 1 and the upper chamber 23. The rotary valve 40 controls the flow of the working gas flowing between the compressor 1 and the cylinder 2.

Specifically, the rotary valve 40 switches the flow of the working gas between the high-pressure working gas generated at the compressor 1 from the high-pressure side 1*b* into the first-stage cylinder 11 and the second-stage cylinder 12, and the adiabatically-expanded and cooled working gas from the first-stage cylinder 11 and the second-stage cylinder 12 to the low-pressure side 1*a* of the compressor 1.

As illustrated in FIGS. 1 and 3, the rotary valve 40 includes a stator valve 41 and a rotor valve 42. The stator valve 41 includes a flat stator valve side sliding face 45, and the rotor valve 42 includes a flat rotor valve side sliding face 50. The stator valve side sliding face 45 and the rotor valve side sliding face 50 (also simply referred to as "sliding faces 45 and 50" hereinafter) are configured to be in sliding contact with each other.

The stator valve 41 is fixed to the housing 3 by a fixing pin 43. The fixing pin 43 restricts the stator valve 41 from rotating. However, the stator valve 41 is configured to be able to move within a predetermined range in the directions of arrows Y1 and Y2 shown in FIG. 1 (referred to as "Y1 direction" and "Y2 direction" hereinafter).

The rotor valve 42 has an engagement hole (not shown) for engaging the crank pin 33*b* formed at an opposite side face 52 positioned opposite the rotor valve side sliding face 50. When the crank pin 33*b* is inserted through the bearing 37, a tip portion of the crank pin 33*b* protrudes in the Y1 direction from the bearing 37 (see FIG. 1). This tip portion of the crank pin 33*b* engages the engagement hole that is formed at the opposite side face 52 of the rotor valve 42.

Thus, when the crank pin 33*b* is eccentrically rotated around a crank shaft 33*a* of the crank member 33 (rotation shaft 31*a* of the motor 31), the rotor valve 42 is rotated in synch with the scotch yoke mechanism 32.

The stator valve 41 has a working gas suction hole 44 arranged to penetrate through its center. The working gas suction hole 44 is connected to the high-pressure side 1*b* of the compressor 1. Also, as illustrated in FIG. 3, the stator valve side sliding face 45 of the stator valve 41 has an arc-shaped groove 46 formed along an arc that is concentric to the working gas suction hole 44. Further, a gas flow path 49 is formed within the stator valve 41 and the housing 3. The gas flow path 49 includes a valve side flow path 49*a* formed within the stator valve 41 and a housing side flow path 49*b* formed within the housing 3.

An opening 48 at one end portion of the valve side flow path 49*a* communicates with the arc-shaped groove 46, and the other end portion 47 of the valve side flow path 49*a* forms an opening at a side face of the stator valve 41 and communicates with one end portion of the housing side flow path 49*b*. The other end portion of the housing side flow path 49*b* is connected to the upper chamber 23.

The rotor valve 42 includes a groove 51 and an arc-shaped hole 53. The groove 51 is formed on the rotor valve side sliding face 50 and is arranged to extend radially from its center. The arc-shaped hole 53 is arranged to penetrate through the rotor valve 42 from the rotor valve side sliding face 50 to the opposite side face 52. The arc-shaped hole 53 is formed along the same circumference as the arc-shaped groove 46 of the stator valve 41.

The working gas suction hole 44, the groove 51, the arc-shaped groove 46, and the opening 48 form a suction valve. Also, the opening 48, the arc-shaped groove 46, and the arc-shaped hole 53 form an exhaust valve.

As described above, the high-pressure working gas is supplied from the compressor 1 to the working gas suction hole 44. A part of the working gas supplied to the working gas suction hole 44 is introduced into a pressure introducing space 57 formed between the housing 3 and a face 41*c* on the opposite side of the stator valve side sliding face 45 of the stator valve 41 (referred to as "pressure receiving face 41*c*" hereinafter).

Also, a spring 60 that presses the stator valve 41 toward the rotor valve 42 is arranged to face the pressure receiving face 41*c*. Note that the spring 60 is described in greater detail below.

In the GM refrigerator having the above-described configuration, when the scotch yoke 34 reciprocates in the Z1 and Z2 directions, the first-stage cylinder displacer 13 and the second-stage displacer 14 are driven to reciprocate in the Z1 and Z2 directions within the first-stage cylinder 11 and the second-stage cylinder 12 between a top dead center UP and a bottom dead center LP.

When the first-stage displacer 13 and the second-stage displacer 14 reach the bottom dead center LP, the exhaust valve closes, the suction valve opens, and a working gas flow path is formed by the working gas suction hole 44, the arc-shaped groove 46, the groove 51, and the gas flow path 49. In turn, high-pressure gas starts to be supplied from the compressor 1 to the upper chamber 12. Thereafter, the first-stage displacer 13 and the second-stage displacer 14 start to move upward from the bottom dead center LP, and the working gas passes through the regenerator materials 17 and 18 from the upper side toward the lower side to be filled into the expansion chambers 21 and 22.

When the first-stage displacer 13 and the second-stage displacer 14 reach the top dead center UP, the suction valve closes, the exhaust valve opens, and a working gas flow path is formed by the gas flow path 49, the arc-shaped groove 46, and the arc-shaped hole 53. In turn, the high-pressure working gas within the expansion chambers 21 and 22 are adiabatically-expanded and cooled to thereby cool the cooling stages 19 and 20. The low temperature working gas that has produced cooling flows from the lower side toward the upper side to cool the regenerator materials 17 and 18, and flows back to the lower-pressure side 1*a* of the compressor 1.

Then, when the first-stage displacer 13 and the second-stage displacer 14 reach the bottom dead center LP, the exhaust valve closes, the suction valve opens, and one operation cycle is completed at this point. By repeating the above operation cycle of compressing and expanding the working gas, the GM refrigerator may generate cooling for achieving a refrigeration effect.

In the following, the rotary valve 40 is described in greater detail.

As described above, the rotary valve 40 rotates the rotor valve 42 with respect to the stator valve 41 to selectively connect the gas flow path 49, which is connected to the upper chamber 23 (and the expansion chambers 21 and 22), to the working gas suction hole 44 or the arc-shaped hole 53. In this way, the rotary valve 40 enables switching of flow paths for the working gas. Also, because the working gas suction hole 44, the arc-shaped groove 46, the groove 51, and the arc-shaped hole 53 have to be kept sealed, the rotary valve 40 includes a mechanism for pressing the stator valve 41 toward the rotor valve 42.

In the present embodiment, the pressure introducing space 57 is formed between the pressure receiving face 41*c* of the stator valve 41 and the housing 3, and the spring 60 is arranged to face the pressure receiving face 41*c*. With such a configuration, the stator valve 41 may be pressed toward the rotor valve 42.

When high-pressure working gas is introduced from the compressor 1 into the pressure introducing space 57, a pressure is applied to the pressure receiving face 41*c*, and the stator valve 41 is pressed toward the rotor valve 42 as a result. Also, the spring 60 presses the pressure receiving face 41*c*, and the stator valve 41 is pressed toward the rotor valve 42 by the pressure of the spring 60 as well.

As described above, the sliding faces 45 and 50 of the stator valve 41 and the rotor valve 42 have elements such as the working gas suction hole 44, the arc-shaped groove 46, the groove 51, and the arc-shaped hole 53 formed thereon for enabling the switching of flow paths for the working gas. These elements are interconnected at predetermined timings as the rotor valve 42 is rotated.

Figure 4:
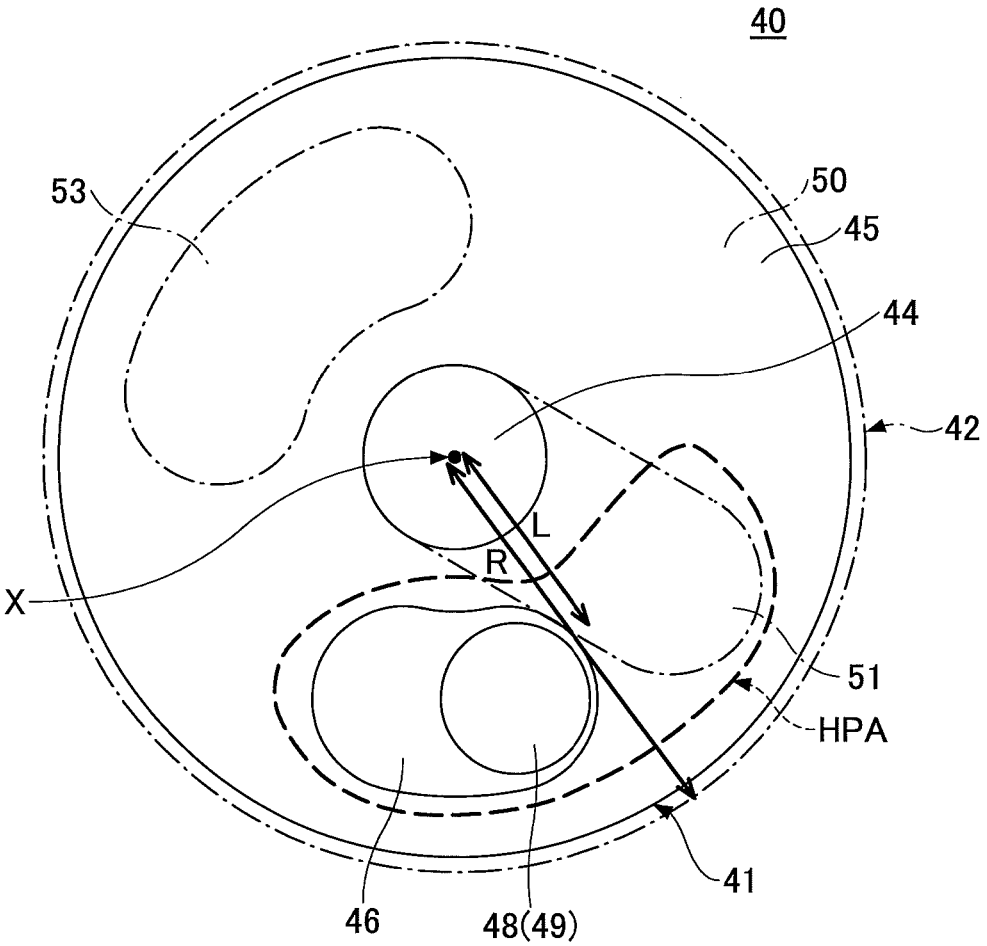
FIG. 4 is an enlarged view of sliding faces of the rotary valve.

FIG. 4 illustrates a state of the rotary valve 40 at the time a suction operation is completed. FIG. 4 illustrates the rotary valve 40 as viewed from a center of rotation X of the rotary valve 40. Note that in FIG. 4, solid lines represent features of the stator valve 41 and one-dotted lines represent features of the rotor valve 42. In the present embodiment, the stator valve 41 and the rotor valve 42 are arranged to be concentric with the center of rotation X of the rotor valve 40.

In FIG. 4, the working gas suction hole 44 is connected to the compressor 1, and therefore, the pressure within the groove 51 connected to the working gas suction hole 44 may be relatively high. Also, because the working gas within the expansion chambers 21 and 22 are not yet expanded at the time the gas suction operation has just been completed, the pressure within the arc-shaped groove 46 connected to the gas flow path 49, which is connected to the expansion chambers 21 and 22, may be relatively high. Further, at the time the suction operation is completed, the arc-shaped groove 46 and the groove 51 at high pressures are located relatively close to each other as illustrated in FIG. 4.

In this case, both the pressure of the working gas from the compressor 1 and the pressure of the working gas supplied to the cylinder 2 are applied to a region where the stator valve side sliding face 45 and the rotor valve side sliding face 50 come into sliding contact with each other, such a region being encircled by a broken line and indicated by an arrow HPA in FIG. 4 (referred to as "bilateral action region HPA" hereinafter). Further, the bilateral action region HPA is eccentrically positioned with respect to the center of rotation (central axis) X of the rotary valve 40.

In this case, the center of a force from the pressure of the working gas pressing the stator valve 41 to the rotor valve 42 is positioned at the center of rotation X of the rotary valve 40. However, the center of a force from the pressure of the working gas pressing the stator valve 41 in a reverse direction to separate the stator valve side sliding face 45 from the rotor valve side sliding face 50 deviates from the center of rotation X of the rotary valve 40. As a result, sealing capability at the bilateral action region HPA may be degraded compared to the other sliding face portions, and the working gas may be prone to leakage at the bilateral action region HPA.

In this respect, in the GM refrigerator of the present embodiment, the center of a force of the spring 60 pressing the stator valve 41 toward the rotor valve 42 is arranged to deviate from the center of rotation X of the rotary valve 40, the amount of deviation being represented by $\Delta X$ and the deviated center being indicated by a one-dotted line Xp in FIG. 1 (referred to as "pressing center Xp" hereinafter).

Note that the force acting to slightly tilt the stator valve 41 and separate the sliding faces 45 and 50 from each other may be at its maximum at the time the suction operation is completed where the arc-shaped groove 46 and the groove 51 are located relatively close to each other (i.e., when the bilateral action region HPA is formed) as described above.

Accordingly, in the present embodiment, the pressing center Xp of the pressing force of the spring 60 is deviated toward the gas flow path 49 communicating with the arc-shaped groove 46.

With such a configuration, portions of the sliding faces 45 and 50 that receive the pressing force of the spring 60 may be located toward the gas flow path 49 (opening 48). That is, the portions receiving the pressing force of the spring 60 may be located close to the bilateral action region HPA. According to an aspect of the present embodiment, by having the spring 60 apply an offset load to press the stator valve 41 toward the rotor valve 42 at the bilateral action region HPA where the amount of force acting to slightly tilt the stator valve 41 and separate the sliding face 45 and 50 from each other is at its maximum, the slight amount of tilting of the stator valve 41 caused by a deviation component with respect to the center of the force pressing back the stator valve 41 from the rotor valve side sliding face 50 may be reduced, and leakage of the working gas resulting from the pressure of the working gas acting to separate the sliding faces 45 and 50 from each other may be prevented, for example.

In a preferred embodiment, the position of the pressing center Xp of the pressing force of the spring 60 with respect to the radial directions of the sliding faces 45 and 50 as viewed from the center of rotation X of the rotary valve 40 is arranged so that the pressing center Xp is positioned no farther than half the radius R of the rotary valve 40 as viewed from the center of rotation X of the rotary valve 40 (i.e., the pressing center Xp is positioned within the range of bidirectional arrow L shown in FIG. 4). In this way, the pressing center Xp of the pressing force of the spring 60 may be positioned within the bilateral action region HPA.

Figure 5:
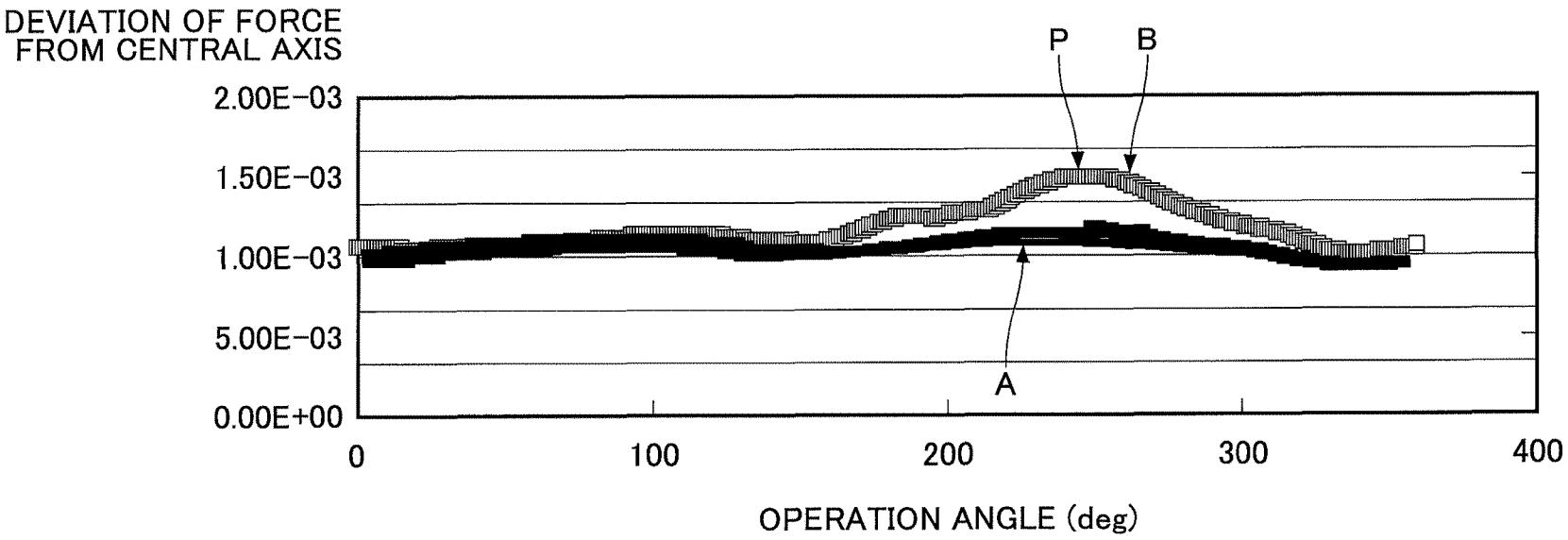
FIG. 5 is a graph illustrating characteristics of a GM refrigerator according to an embodiment of the present invention.

FIG. 5 is a graph illustrating characteristics of the GM refrigerator of the present embodiment. In the graph of FIG.

5, line A represents the characteristics of the GM refrigerator of the present embodiment, and line B represents characteristics of a conventional GM refrigerator with the center of a spring force pressing a stator valve matching the center of rotation of the rotary valve as a comparison example. Note that in the graph of FIG. 5, the lateral axis represents a rotation angle (operation angle) of the rotary valve 40 with respect to the stator valve 41, and the vertical axis represents an amount of deviation of a force applied to the stator valve 41 from the center of rotation X (central axis) of the rotary valve 40, the force being applied to the stator valve 41 by the working gas and the spring 60.

As can be appreciated from FIG. 5, in the conventional GM refrigerator, a positional deviation of the force applied to the stator valve 41 by the working gas occurs at an operation angle of approximately 250 degrees corresponding to the time a suction operation is completed (see arrow P in FIG. 5). Note that a risk of leakage may be highest at the time the suction operation is completed as described above, such a time being referred to as "timing at issue" hereinafter.

In contrast, in the GM refrigerator of the present embodiment, although slight increases in the deviation amount occur at times other than the timing at issue, the amount of deviation of the force applied to the stator 41 is reduced at the timing at issue where the risk of leakage is high. Such an effect may be attributed to the pressing force of the spring 60 pressing the stator valve 41 toward the rotor valve 42 at the bilateral action region HPA. That is, even when the rotor valve 42 is rotated such that the arc-shaped groove 46 and the groove 51 at high pressures are positioned close to each other, and a force acts on the bilateral action regions HPA to slightly tilt the stator valve 41 and separate the sliding faces 45 and 50 from each other, the pressing force of the spring 60 pressing the stator valve 41 toward the rotor valve 42 at the bilateral action region HPA may counteract such a force to thereby prevent the deviation of the force applied to the stator 41.

Accordingly, in the GM refrigerator of the present embodiment, the working gas may be prevented from leaking at the sliding contact position of the sliding faces 45 and 50 of the rotary valve 40 even at the time a suction operation is completed.

Note that in the present embodiment, the position of the force of the spring 60 is deviated from the center; however, spring characteristics such as the spring constant of the spring 60 may be the same as the spring used in the conventional GM refrigerator, for example. In this case, the amount of pressing force pressing the stator valve 41 to the rotor valve 42 may be the same as the conventional GM refrigerator (i.e., the pressing force is not increased).

In this way, in the GM refrigerator of the present embodiment, working gas may be prevented from leaking between the stator valve 41 and the rotor valve 42 without increasing wear between the stator valve side sliding face 45 and the rotor valve side sliding face 50.

In the following, a GM refrigerator according to a second embodiment of the present invention is described.

Figure 6:
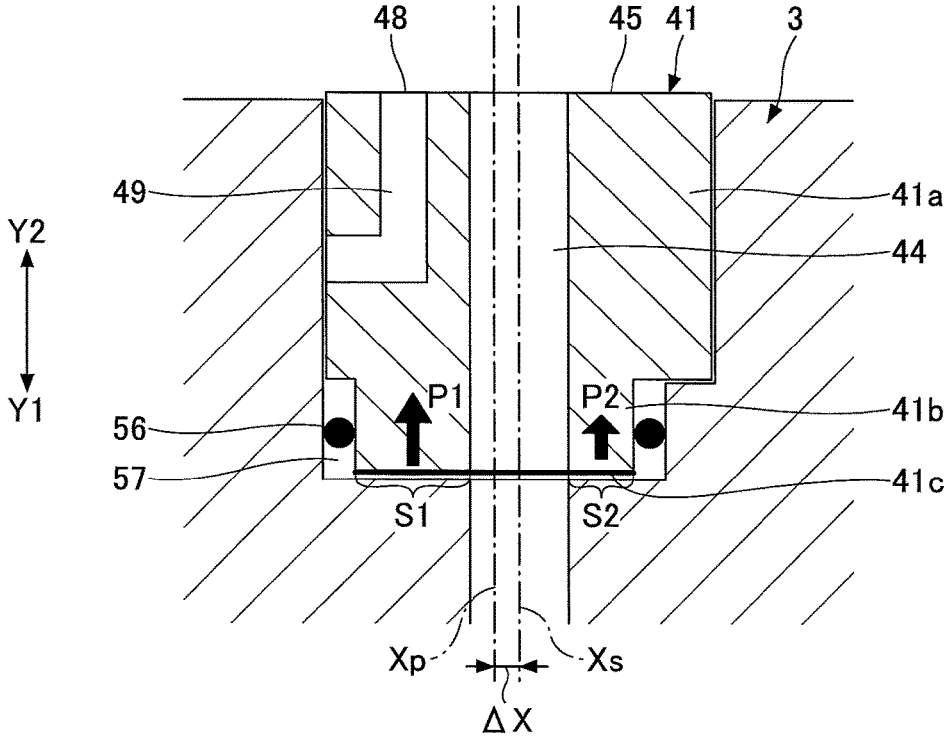
FIG. 6 is an enlarged cross-sectional view of a stator valve of a GM refrigerator according to another embodiment of the present invention.

FIG. 6 is an enlarged view of the stator valve 41 of the GM refrigerator according to the second embodiment. Note that in FIG. 6, features that are substantially identical to the features illustrated in FIGS. 1-4 are given the same reference numerals, and their descriptions are omitted.

In the GM refrigerator of the second embodiment, the stator valve 41 has a different configuration from that of the stator valve 41 of the above-described first embodiment. Other features of the second embodiment may be identical to those of the first embodiment.

In the GM refrigerator of the first embodiment, the pressing center Xp of the pressing force of the spring 60 is deviated from the center of rotation X of the rotary valve 40, and in this way, seal of the rotary valve 40 may be maintained even at the time a suction operation is completed where a force acting to slightly tilt the stator valve 41 and separate the sliding faces 45 and 50 from each other is at its maximum (i.e., when the bilateral action region HPA is formed).

In the second embodiment, the pressure of the working gas applied to the pressure receiving face 41*c* of the stator valve 41 is used to maintain seal of the rotary valve 40 even at the time a suction operation is completed.

As illustrated in FIG. 6, the stator valve 41 arranged in the GM refrigerator of the second embodiment includes a valve body 41*a* and a pressure receiving part 41*b* that are integrally formed, the valve body 41*a* having a larger radius and the pressure receiving part 41*b* having a smaller radius than the valve body 41*a*.

In the present embodiment, a face of the valve body 41*a* at the opposite side of the pressure receiving part 41*b* corresponds to the stator valve side sliding face 45. Also, a face of the pressure receiving part 41*b* at the opposite side of the valve body 41*a* corresponds to the pressure receiving face 41*c*. The pressure introducing space 57 is arranged between the pressure receiving face 41*c* and the housing 3.

Working gas at a high pressure is introduced from the compressor 1 to the pressure introducing space 57 via the working gas suction hole 44. An O-ring 56 is arranged between the outer peripheral face of the pressure receiving part 41*b* and the housing 3, and in this way, the pressure introducing space 57 may be hermetically sealed and separated from the sliding faces 45 and 50. Thus, the pressure of the working gas introduced into the pressure introducing space 57 is applied to the pressure receiving face 41*c*.

The valve body 41*a* and the pressure receiving part 41*b* are cylindrical structures having different diameters. Assuming the central axis of the valve body 41*a* is denoted as stator center Xs, and the central axis of the pressure receiving part 41*b* is denoted as pressing center Xp, the stator center Xs and the pressing center Xp are deviated from each other (eccentrically positioned) in the present embodiment, the amount of deviation between the stator center Xs and the pressing center Xp being represented by ΔX in FIG. 6. Also, in the present embodiment, the pressing center Xp is arranged to deviate toward the gas flow path 49 side with respect to the stator center Xs.

Further, in the present embodiment, the central axis of the working gas suction hole 44 is arranged to match the stator center Xs. Accordingly, the central axis of the working gas suction hole 44 is also deviated (eccentrically positioned) with respect to the pressing center Xp corresponding to the center of the pressure receiving face 41*c*.

Also, assuming a plane perpendicular to the plane of FIG. 6 and including the pressing center Xp is referred to as "center plane," S1 denotes a pressure receiving area of the pressure receiving face 41 toward the gas flow path 49 side (left side in FIG. 6) with respect to the center plane, and S2 denotes a pressure receiving area of the pressure receiving face 41*c* at the opposite side of the gas flow path 49 (right side of FIG. 6) with respect to the center plane, the pressure receiving area S1 at the gas flow path 49 side is greater than the pressure receiving area S2 at the opposite side (i.e., S1>S2).

Thus, assuming P1 denotes the total sum of the force of the working gas pressing the pressure receiving face 41*c* at the gas flow path 49 side with respect to the center plane, and P2 denotes the total sum of the force of the working gas pressing the pressure receiving face 41*a* at the opposite side of the gas flow path 49 with respect to the center plane, P1>P2.

That is, in the present embodiment, a stronger force is applied to a portion of the pressure receiving face 41*c* toward the gas flow path 49 side (i.e., corresponding to the bilateral action region HPA) compared to the other portions of the pressure receiving face 41*c*, and in this way, the sliding faces 45 and 50 may be prevented from separating from each other by the pressure of the working gas acting to slightly tilt the stator valve 41 and separate the sliding faces 45 and 50 from each other and leakage of the working gas may be prevented even at the time a suction operation is completed.

In the following, a GM refrigerator according to a third embodiment of the present invention is described.

Figure 7:
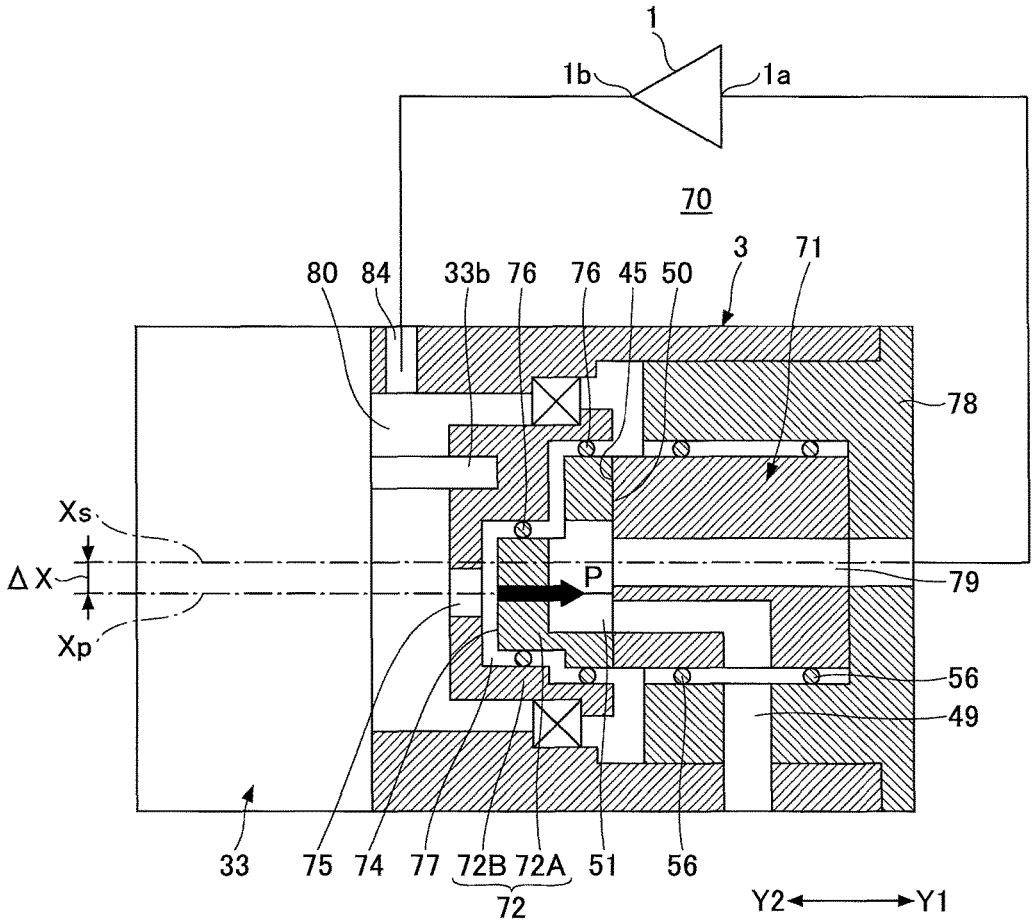
FIG. 7 is an enlarged cross-sectional view of a rotary valve of a GM refrigerator according to another embodiment of the present invention.

FIG. 7 is an enlarged view of a rotary valve 70 of the GM refrigerator according to the third embodiment. Note that in FIG. 7, features that are substantially identical to the features illustrated in FIGS. 1-6 are given the same reference numerals and their descriptions are omitted.

In the GM refrigerator of the third embodiment, the rotary valve 70 has a different configuration from that of the rotary valve 40 described above. Other features of the third embodiment may be identical to those of the first embodiment. Accordingly, the rotary valve 70 and its vicinity are illustrated and explained in the following description of the third embodiment.

In the GM refrigerator of the second embodiment, the high-pressure working gas supplied from the compressor 1 is arranged to act on the pressure receiving face 41*c* of the stator valve 41 so that seal between the sliding faces 45 and 50 may be maintained and the working gas may be prevented from leaking.

In the GM refrigerator of the third embodiment, the rotary valve 70 has a pressure receiving face 74 arranged at the opposite side of a rotor valve side sliding face 50 of a rotor valve 72, and the high-pressure working gas supplied from the compressor 1 is arranged to act on the pressure receiving face 74 of the rotor valve 72. The configuration of the rotary valve 70 of the third embodiment is described in further detail below.

A stator valve 71 is fixed to a flange member 78, which is attached to the housing 3. A working gas exhaust hole 79 penetrates through the stator valve 71 and the flange member 78. The working gas exhaust hole 79 is connected to the lower pressure side 1*a* of the compressor 1. Further, O-rings 56 are arranged between the outer peripheral face of the stator valve 71 and the flange member 78 in order to prevent high-pressure working gas from leaking into the working gas exhaust hole 79.

The rotor valve 72 is arranged to be rotatable within the housing 3. The rotor valve 72 includes an inner part 72A formed at the inner side and an outer part 72B arranged to accommodate the inner part 72A.

A face of the inner part 72A facing the stator valve 71 corresponds to the rotor valve side sliding face 50, which comes into sliding contact with the stator valve side sliding face 45 of the stator valve 71. As with the rotor valve side sliding face 50 of the rotor valve 42 of the first embodiment, the rotor valve side sliding face 50 of the rotor valve 72 of the present embodiment has a groove 51 formed thereon. A face of the inner part 72A at the opposite side of the rotor valve side sliding face 50 corresponds to the pressure receiving face 74.

The outer part 72B is arranged to be rotatable within the housing 3 and comes into engagement with a crank pin 33*b* of a crank member 33. Thus, when the motor 31 is driven and the crank 33 is rotated, the rotational force of the crank 33 may be transmitted to the rotor valve 72 via the crank pin 33*b*, and in this way, the rotor valve 72 may be rotated.

Also, a working gas filling space 80 is formed between the housing 3 and the outer part 72B. A working gas suction hole 84 that communicates with the working gas filling space 80 is formed at the housing 3, and the working gas suction hole 84 is connected to the high-pressure side 1*b* of the compressor 1. In this way, high-pressure working gas from the compressor 1 is supplied to the working gas filling space 80.

Also, a pressure introducing space 77 is formed between the inner part 72A and the outer part 72B of the rotor valve 72. The pressure introducing space 77 is formed between the pressure receiving face 74 of the inner part 72A and the inner wall of the outer part 72B.

Further, a pressure introducing hole 75 is formed at the outer part 72A at a position facing the pressure introducing space 77. Thus, when the high-pressure working gas generated at the compressor 1 is introduced into the working gas filling space 80 via the working gas suction hole 84, the working gas flows into the pressure introducing space 77 via the pressure introducing hole 75 and presses the pressure receiving face 74. Note that the inner part 72A is configured to be movable in the Y1 and Y2 directions by a predetermined distance with respect to the outer part 72B.

The pressure receiving face 74 that is pressed by the working gas is arranged into a circular shape. Also, the stator valve 71 is arranged into a cylindrical shape. In the following descriptions, a central axis of the pressure receiving face is referred to as "pressing center Xp," and a central axis of the stator valve 71 is referred to as "stator center Xs."

In the GM refrigerator of the present embodiment, the pressing center Xp of the pressure receiving face 74 is deviated (eccentrically positioned) with respect to the stator center Xs of the stator valve 71, the amount of deviation being represented by ΔX in FIG. 7. As for the deviating direction, the pressing center Xp is arranged to deviate toward the gas flow path 49 side with respect to the stator center Xs.

Accordingly, in the GM refrigerator of the present embodiment where the rotor valve 72 is arranged to be pressed toward the stator valve 71 by the pressure of the working gas from the compressor 1, the rotor valve 72 may be pressed to the stator valve 71 with a stronger force at a portion toward the gas flow path 49 side of the sliding faces 45 and 50 (corresponding to the bilateral action region HPA) compared to other portions. In this way, even at the time a suction operation is completed, the inner part 72A of the rotor valve 72 may be prevented from tilting and the sliding faces 45 and 50 may be prevented from being separated from each other so that leakage of the working gas may be prevented.

While certain preferred embodiments of the present invention have been described above, the present invention is not limited to these embodiments, and various changes and modifications may be made without departing from the scope of the present invention.

For example, in the above-described first embodiment, one spring 60 is arranged to press the stator valve 41 toward the rotor valve 72, and the pressing center Xp of the spring 60 is arranged to deviate toward the gas flow path 49 side with respect to the center of rotation X of the rotary valve 40.

However, in an alternative embodiment, multiple springs having different spring constants may be used as a forcing mechanism for pressing the stator valve 41 toward the rotor valve 42, and a spring with a large spring constant may be arranged at a portion corresponding to the bilateral action region HPA while a spring with a smaller spring constant may be arranged at the other portions. Such a configuration may also prevent the inner part 72A of the rotor valve 72 from tilting and causing the sliding faces 45 and 50 to separate from each other to cause leakage of the working gas.

What is claimed is:

1. A cryogenic refrigerator, comprising:

a compressor that compresses a working gas;

an expansion chamber where the working gas compressed by the compressor expands and generates cooling;

a valve mechanism including a stator valve and a rotor valve, which rotates with respect to the stator valve, said rotor valve being rotatably supported by a bearing so as not to be movable in a direction of a rotation axis of the rotor valve and said stator valve being supported so as not to be movable in a rotation direction of the rotor valve and so as to be movable in the direction of the rotation axis of the rotor valve, the valve mechanism being configured to switch a flow of the working gas between the compressor and the expansion chamber as the rotor valve rotates; and a forcing mechanism that consists essentially of only a single spring that is provided so as to contact the stator valve and apply a force to the stator valve toward the rotor valve;

wherein a center of an entire force applied by the forcing mechanism to the stator valve is arranged to deviate from a center of the valve mechanism, and wherein the single spring is arranged so that a center of the single spring deviates from the center of the valve mechanism, said single spring applying the force to the one of the rotor valve or the stator valve toward the other one of the rotor valve or the stator valve.

2. The cryogenic refrigerator as claimed in claim 1, wherein the stator valve includes a gas flow path that communicates with the expansion chamber; and the center of the force applied by the forcing mechanism is positioned toward the gas flow path with respect to the center of the valve mechanism.

3. The cryogenic refrigerator as claimed in claim 1, wherein the center of the force applied by the forcing mechanism is positioned within an inner half radius of a radius of the valve mechanism as viewed from the center of the valve mechanism.

4. The cryogenic refrigerator as claimed in claim 1, wherein the forcing mechanism includes a fixing pin provided to an opposite side from the single spring relative the center of the valve mechanism and configured to fix the stator valve to a housing of the cryogenic refrigerator.

5. The cryogenic refrigerator as claimed in claim 1, wherein the spring is provided on a side opposite from a motor relative to the rotor valve.

6. A cryogenic refrigerator, comprising:

a compressor that includes a high pressure side and a low pressure side, and compresses a working gas;

an expansion chamber where the working gas compressed by the compressor expands and generates cooling;

a valve mechanism including a stator valve and a rotor valve, which rotates with respect to the stator valve, said rotor valve being rotatably supported by a bearing so as not to be movable in a direction of a rotation axis of the rotor valve and said stator valve being supported so as not to be movable in a rotation direction of the rotor valve and so as to be movable in the direction of the rotation axis of the rotor valve, the valve mechanism being configured to switch a flow of the working gas between the compressor and the expansion chamber as the rotor valve rotates;

a housing that accommodates the valve mechanism, a sealing member that is provided between the housing and the stator valve;

a pressure introducing space that is defined by a pressure receiving face that is arranged at an opposite side of the stator valve with respect to a face that contacts with the rotor valve, the housing, and the sealing member; the compressed working gas being supplied to the pressure introducing space, said pressure introducing space being consistently connected to the high pressure side of the compressor, and a gas hole that penetrates through the stator valve;

wherein a center of the pressure receiving face is arranged to deviate from a rotation axis of the valve mechanism, and wherein a center of an entire force applied to the stator valve is arranged to deviate from the rotation axis of the valve mechanism.

7. The cryogenic refrigerator as claimed in claim 6, wherein the stator valve includes a gas flow path that communicates with the expansion chamber, and wherein the pressure receiving face is divided by the center of the pressure receiving face into a first face and a second face, said first face being closer to the gas flow path than the center of the pressure receiving face and said second face being farther to the gas flow path than the center of the pressure receiving face, and wherein said first face is larger than the second face.

8. A cryogenic refrigerator, comprising:

a compressor that includes a high pressure side and a low pressure side, and compresses a working gas;

an expansion chamber where the working gas compressed by the compressor expands and generates cooling;

a valve mechanism including a stator valve and a rotor valve, which rotates with respect to the stator valve, said rotor valve being rotatably supported by a bearing so as not to be movable in a direction of a rotation axis of the rotor valve and said stator valve being supported so as not to be movable in a rotation direction of the rotor valve and so as to be movable in the direction of the rotation axis of the rotor valve, the valve mechanism being configured to switch a flow of the working gas between the compressor and the expansion chamber as the rotor valve rotates;

a housing that accommodates the valve mechanism, and a pressure introducing space that is defined by a pressure receiving face that is arranged at an opposite side of the stator valve with respect to a face that contacts with the stator valve and the housing; the compressed working gas being supplied to the pressure introducing space, said pressure introducing space being consistently connected to the high pressure side of the compressor, wherein a center of the pressure receiving face is arranged to deviate from a rotation axis of the valve mechanism, and wherein a center of an entire force applied to the stator valve is arranged to deviate from the rotation axis of the valve mechanism.

* * * * *